United States Patent [19]

Lawther

[11] Patent Number: 4,648,323

[45] Date of Patent: Mar. 10, 1987

[54] FRAGMENTATION MUNITION

[75] Inventor: Robert J. Lawther, Orange, Calif.

[73] Assignee: Northrop Corporation, Hawthorne, Calif.

[21] Appl. No.: 129,698

[22] Filed: Mar. 6, 1980

[51] Int. Cl.[4] ..... F42B 13/18

[52] U.S. Cl. ..... 102/495; 102/417

[58] Field of Search ..... 102/67, 68, 69, 492, 102/494, 495, 496, 497

[56] References Cited

U.S. PATENT DOCUMENTS

| | | | |
|---|---|---|---|
| 3,081,704 | 3/1963 | Boswell | 102/67 |
| 3,298,308 | 1/1967 | Throner, Jr. | 102/67 |
| 3,489,088 | 1/1970 | Von Ballmoos et al. | 102/68 |
| 3,742,856 | 7/1973 | Welanetz | 102/67 |
| 3,956,990 | 5/1976 | Rowe | 102/67 X |
| 3,980,019 | 9/1976 | Anderson et al. | 102/69 X |
| 4,004,518 | 1/1977 | Potteiger et al. | 102/67 |
| 4,026,213 | 5/1977 | Kempton | 102/67 X |

*Primary Examiner*—Peter A. Nelson

*Attorney, Agent, or Firm*—Terry J. Anderson

[57] ABSTRACT

A warhead assembly having an explosive core and a surrounding annular package with several circumferential rows of different sized preformed fragments or rods. In each of one or more row, the fragments are alternately inverted keystone shapes arranged in a circle, with the adjacent sides fitting against each other in essentially pressure-confining contact. Further, the fragments which have their wider sides facing radially outward are composed of much higher density metal than the alternating fragments having their wider sides facing inward. This causes the lower density fragments to push the higher density fragments out at a high velocity when exploded.

11 Claims, 7 Drawing Figures

FRAGMENTATION MUNITION

BACKGROUND OF THE INVENTION

1. Field of the Invention

The present invention relates to fragmentation munitions, and more particularly, to an explosive fragmenting warhead type package having improved target-penetrating ability.

2. Description of the Prior Art

Conventional fragmentation type of warheads, bombs, rockets and the like have an annular body with an explosive charge in the center and rows of fragments or rods assembled around the center and contained in a thin outer cylindrical casing, for example. Some designs employ a solid type structure surrounding the explosive core, which splits into fragments at specially weakened points when the charge is set off. To penetrate an armored target when the fragments are thrown out by the high explosive, such fragments are designed to have as high a ballistic coefficient as possible, achieved by high density material and low cross-section area in the direction of travel, and to have high explosive launch velocity. The present invention is aimed at providing a higher relative velocity of high density fragments for a given initial size of package including explosive material and fragment material.

U.S. Pat. No. 3,464,356 shows rod type penetrators having collapsible flared sections on the rear ends for aerodynamic stabilization during flight after separation at the time of explosion. Such stabilization has proved ineffective at the shorter distances from the explosion point.

U.S. Pat. No. 3,977,327 discloses a fragmentation arrangement having keystone shaped fragments so that when assembled in curved fashion, the sides of the fragments will be in total contact with each other. However, when the fragments are separated from each other immediately after detonation, the internal pressure is at once drastically reduced.

U.S. Pat. No. 4,080,900 discloses a spinning projectile assembly comprising a nose and a tail section separable by means of a longitudinally operating piston and cylinder when a contained explosive charge is detonated. A bundle of rods, initially surrounding the piston and cylinder, is thus freed to escape, and the rods fly apart due to centrifugal action only. The rods are preformed, in a certain embodiment, to triangular shapes and fitted side-by-side in alternate pointing directions for maximum packing density.

SUMMARY OF THE INVENTION

An overall object of this invention is to provide a fragmentation weapon wherein high density fragments are propelled at a maximum velocity for a given size (diameter) of weapon casing.

It is another object of the present invention to provide a means and method of retaining the explosive gas pressures in a munition more efficiently to attain higher launch velocities of the fragments.

A further object is to provide means for launching higher density fragment metal at velocities higher than conventionally attainable with a given ratio of explosive charge to total fragment metal.

Briefly, my invention comprises preforming fragment material into keystone shapes and assembling an annular arrangement of alternately opposite-aligned shapes so that one keystone piece has the wide side facing outward and the adjacent keystone has the wide side facing inward. This arrangement is continued sequentially around the body assembly. Another aspect of the invention includes using appreciably higher density material for the fragments or pieces whose wide sides face outward than for the alternate fragments in the ring. The lower density portion can be provided as the individual separate fragments or can be composed of an integral casing which splits apart when exploded, such casing initially having the higher density fragments embedded therein at assembly.

As well as alternating the side slopes of the fragments in the circumferential direction around the munition, the same is preferably done with the ends of the fragments in the longitudinal direction along the munition.

In another embodiment, preformed "keystone" fragments of the higher density material are embedded in a pattern of mating formed holes in an integral cylindrical casing forming the exploded body of the munition. In this case, the casing is made of the lower density fragment material and is built to shatter, when exploded, into pieces serving as the opposite keytone shapes for pushing out the embedded preformed fragments.

This invention will be more fully understood by reference to the detailed description of a specific embodiment to follow, and to the accompanying illustrative drawings.

DESCRIPTION OF THE PREFERRED EMBODIMENT

Figure 1:
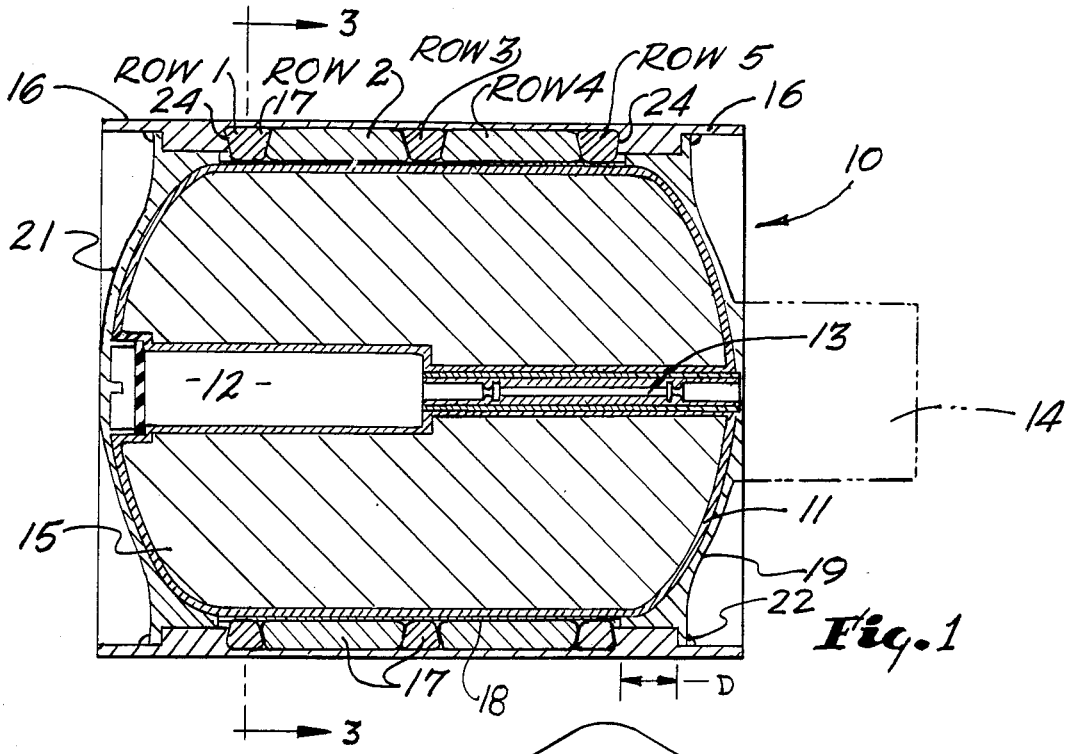
FIG. 1 is a longitudinal section view of a warhead embodying the present invention.

Referring first to FIG. 1, a warhead assembly 10 is shown in longitudinal section. The warhead has a cylindrical exterior shape designed to be installed as a substantially complete section of the body of a missile (not shown). The overall diameter of the warhead 10 is commonly restricted to be equal to the missile diameter.

Warhead 10 has a thin-walled inner plastic container 11 with a central passage therein. This passage contains a conventional booster composition 12 and an explosive lead 13 coming from an arming mechanism 14 shown by dotted lines external to the end of the assembly 10. The remainder of container 11 is filled with high explosive 15.

Figure 2:
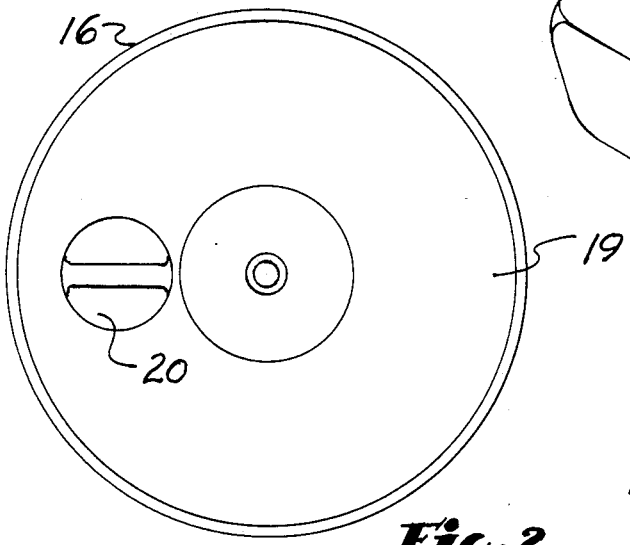
FIG. 2 is a right-hand end view of the warhead.

The container 11 is surrounded by a relatively thin exterior metal casing 16 in which a multiplicity of preformed fragments 17 of various shapes are arranged, as will be discussed in more detail later. A thin tube or liner 18 may be provided between the container 11 and the fragments 17. A right end cover 19 fits the end shape of container 11 and may be lightly welded to the casing 16, as at 22. A filler cap 20 (FIG. 2) in the right end cover 19 allows filling the container 11 with the high explosive 15. A left end cover 21 is similarly provided in casing 16 against the left end of container 11. The casing 16 and covers 19 and 21 together form a rigid but frangible housing for the warhead.

Figure 3:
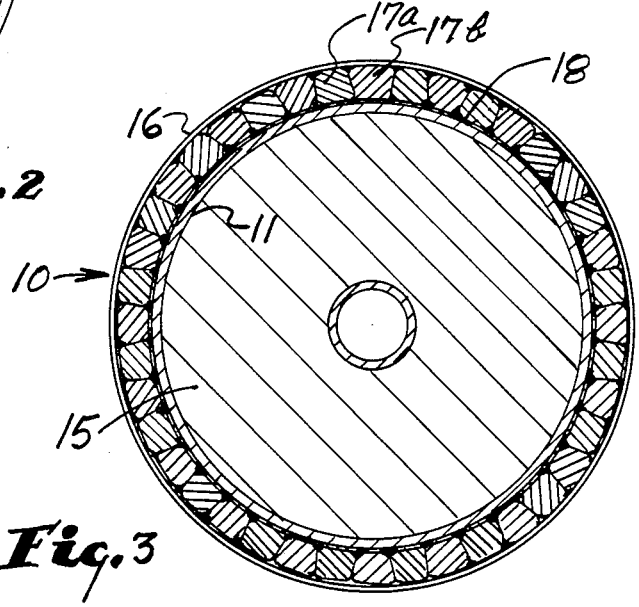
FIG. 3 is a cross section of the warhead viewed as indicated by broken line 3—3 in FIG. 1.

This invention resides in the arrangement, shape, and materials of the fragments 17, of which there are five circumferential rings or rows in the example of FIG. 1. As shown in FIG. 3, the first row of fragments comprises alternately-placed fragment types 17*a* and 17*b*. These are keystone or trapezoidal shaped fragments, fragments type 17*a* having their wide sides in the inner radial direction of the warhead and fragments 17*b* having their wide sides in the outer direction. The angle of slope or taper of the fragments 17*a* is obviously less than that of the fragments 17*b* so that the sides of all fragments fit against each other smoothly and perfectly in a circle around the warhead 10.

Figure 4:
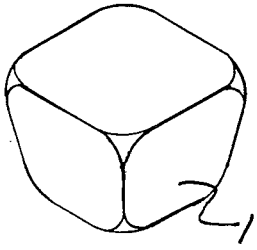
FIG. 4 is an enlarged isometric view of one of the two types of preformed fragments shown in FIG. 3.
Figure 5:
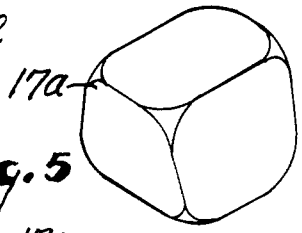
FIG. 5 is an enlarged isometric view of a second type of preformed fragment shown in FIG. 3.
Figure 6:
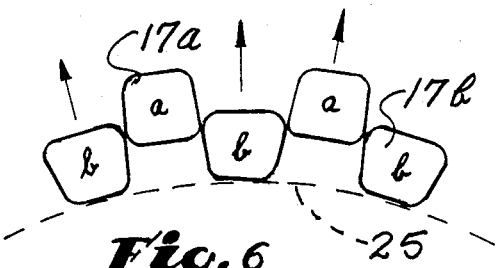
FIG. 6 is a diagram showing a few of the two types of fragments in FIGS. 4 and 5 as they appear during the early part of their outward travel.

The purpose of this alternate keystone shaping will be evident. When the warhead is exploded, and the exterior casing 16 is ruptured, the internal gas pressures are confined by the present fragments even as they travel outwardly, since the oppositely tapered adjacent sides remain in sliding contact until the fragments 17*a* push out completely beyond the fragments 17*b*. This is illustrated in FIG. 6. Here, the fragments 17*a* and 17*b* are illustrated in motion beyond a dotted arc 25 which represents a circle lying significantly outward from the original inner diameter of the fragment assembly. Therefore, all the fragments 17 are given a greater maximum velocity than possible when the explosive pressure starts to decrease rapidly by escaping between the edges of ordinary fragments. FIGS. 4 and 5 give a better understanding of the shapes of fragments 17*a* and 17*b*.

In addition, the fragments 17*b* in my invention may be made of a much higher density material than the fragments 17*a*. If the lower density pieces are made of steel, the higher density pieces may be made of a tungsten alloy, for example. Or, the lighter fragments 17*a* may be titanium and the heavier fragments 17*b* steel, if desired. The result is that the lower density fragments 17*a* with the wide side inward tend to accelerate more rapidly than the higher density fragments 17*b* with the narrow side inward, but actually push the fragments 17*b* out much faster than their unassisted velocity would be, due to the forced side contact described before. Thus, not all of the fragments are denser metal, but a limited number of high density fragments are launched at a higher velocity than normal with equal density fragments in a warhead of the same mass ratio of total fragment mass to explosive charge. Therefore, penetration of a heavily armored target is possible where no penetration was possible prior to this invention.

This structure of fragments 17*a* and 17*b* as so far described provides confinement of internal pressure in the circumferential direction of the warhead. Reference to FIG. 1 again will show that the front and rear sides of adjacent rows of fragments are alternately tapered also, so as to confine pressure between the fragments in the longitudinal direction, also, during the initial period following explosion.

Moreover, it is strongly preferred to initially confine the internal pressure at the opposite ends of the warhead assembly 10, to avoid losing the advantages of this invention due to end-escaping pressure. Note that the end covers 19 and 21 in FIG. 1 are propelled in the direction to maintain sliding contact with the inner surface of the casing 16 as the covers accelerate outwardly in the axial direction. Internal pressure is held momentarily until the distance "D" is exceeded, due to the appreciable length of the longitudinal sliding contact.

The fragments in each of rows 3 and 5 of this design (FIG. 1) are identical to the fragments 17*a* and 17*b* in row 1. The framents in rows 2 and 4 are substantially longer rod-type fragments, and do not necessarily have alternately sloping side faces in the circumferential direction, although they may.

Due to the trapezoidal shape and interlocking arrangement of the fragments 17, and inner end flanges of the exterior casing 16 which have acute-angled fragment-contacting walls 24, the fragments can be stacked in the exterior casing 16 and then the inner container 11 inserted while in a vertical position. If desired, the fragments 17 may be held in place during assembly by a bonding material.

The fragments 17*a* preferably have a larger face area exposed to the explosive center than fragments 17*b* so that a greater total force is exerted on the fragments 17*a*. This is not absolutely essential, however, when using lower density material for fragments 17*a* than for 17*b*, but just so that the fragments 17*a* are caused to move outwardly with respect to the fragments 17*b* to maintain contact with the adjacent sides. In one particular example, the relative angles on fragments 17*a* and 17*b* are such that the outward velocity of fragments 17*a* is about 15% greater than that of fragments 17*b*.

It is thus seen that the present invention prevents initial leakage of explosive pressure past the fragments so that a higher fragment velocity is imparted. The relative fragment sizes, numbers, and keystone angles can be varied depending on the desired terminal effects. The fragments may be trapezoidal shaped or form the frustum of a cone or pyramid. It is also seen that this invention enables launching of heavier fragments at higher velocities than heretofore attainable for a fixed size of munition.

Figure 7:
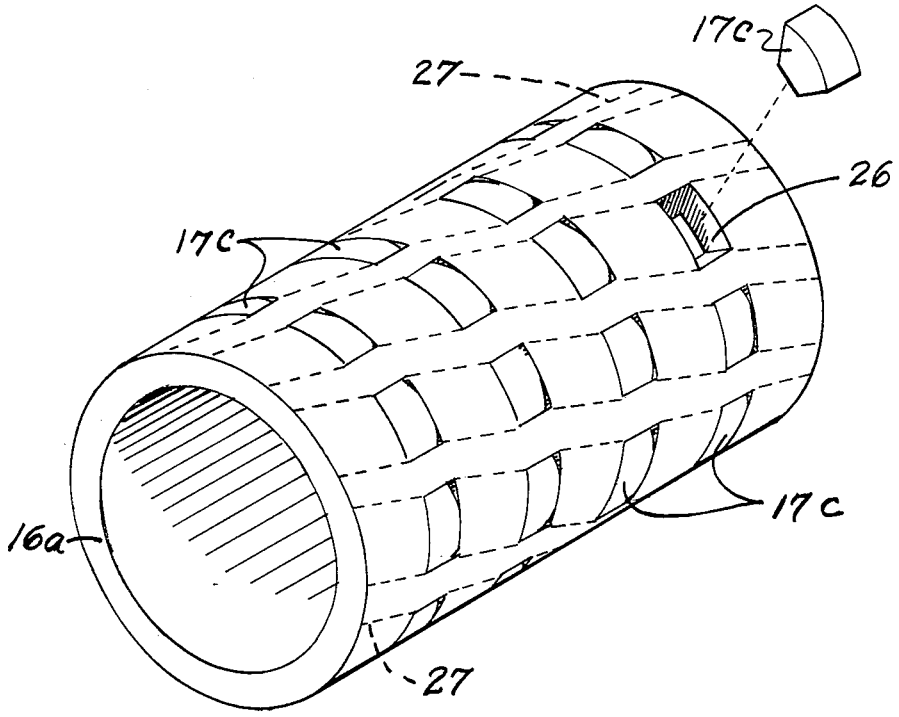
FIG. 7 is a perspective view of a warhead casing assembly showing another embodiment of the present invention, using an integral fragmentable casing with preformed openings therein.

FIG. 7 shows another physical arrangement following the concepts of my invention. Here, an integral casing 16*a* contains a plurality of machined apertures 26, for example, and the usual core of high explosive material (not shown). Each aperture 26 contains a preformed fragment 17*c* therein, shaped to fit, and having substantially wider outer surface dimensions than its inner surface dimensions. One fragment 17*c* is shown removed from its aperture in FIG. 7 for the purpose of illustration of its shape. Fragments 17*c* take the place of fragments 17*b* in the FIG. 1 design and are made of relatively denser fragment material than the casing 16*a*. They may be held in place by an epoxy resin, for example. The casing 16*a* may be grooved as at 27 to aid it, when exploded, to break into pieces performing the function of fragments 17*a* in the design of FIG. 1. If grooved, however, the grooving may be preferred to be made on the inner surface of casing 16*a*.

The same "sliding contact" effect is maintained by the expanding casing 16*a* of FIG. 7 on the higher density keystoned fragments 17*c*, when the munition is exploded. The rows of fragments 17*c* are preferably staggered angularly around casing 16*a* as shown in FIG. 7, to achieve a uniform scattering pattern. The number, relative size and proportions of the fragments depicted in FIG. 7 are intended for illustration purposes only, the only restrictions being their exaggerated keystone shape and relatively higher density.

Although this invention has been illustrated particularly as a missile warhead, it is obvious that the same principles of construction and operation apply to other types of munitions and submunitions, such as rockets, bombs and projectiles. Further, the exterior shape of the assembly can be somewhat tapered from end to end, if desired, rather than a straight cylinder as depicted in FIG. 1. Another layer of fragments constructed and arranged according to the present principles may be provided around the outside of the first layer and inside an enlarged exterior casing.

While in order to comply with the statute, the invention has been described in language more or less specific as to structural features, it is to be understood that the invention is not limited to the specific features shown, but that the means and construction herein disclosed comprise the preferred mode of putting the invention into effect, and the invention is therefore claimed in any of its forms or modifications within the legitimate and valid scope of the appended claims.

What is claimed is:

1. A fragmentation munition comprising a central body of explosive material, and a fragmenting assembly surrounding said central body, said assembly including a plurality of preformed fragments of substantial tapered shape with the wider end on the outside of said assembly, and other fragments of tapered shape with the wider end on the inside of said assembly and having surfaces mating with the tapered sides of said preformed fragments, and one type of said preformed fragments being of higher density than said other fragments, said mating surfaces of said fragments with the wider end on the inside of said assembly having an outward pushing force on said preformed fragments when exploded.

2. Apparatus in accordance with claim 1 wherein said fragmenting assembly is substantially in the form of a cylinder, and including container means housing said central body and said fragmenting assembly.

3. Apparatus in accordance with claim 1 said second plurality of preformed fragments of tapered shape opposite the tapered shape of the first plurality of preformed fragments around said central body, an integral casing means surrounding said fragment assembly and having spaced apertures therein for holding said preformed segments and including means defining grooves therein interconnecting said apertures for controlled fragmentation.

4. In a fragmentation munition having a central explosive body: an annular fragmenting structure comprising a plurality of preformed fragments of substantial tapered shape with the wider end on the outer side of said structure and other preformed fragments in place around said structure in spaced relation, said other preformed fragments having surfaces mating with the tapered sides of said preformed fragments, said mating surfaces of said other preformed fragments having an outward sliding contact with said preformed fragments over an appreciable initial distance following outward separation from said explosive body.

5. A fragmentation munition comprising:

(a) a central body of explosive material;

(b) a purality of fragments assembled around said central body, said fragments including at least one circumferential row of alternate inverted keystone shaped pieces having adjacent faces in contact with each other, the pieces having their wider sides facing radially outward being of substantially different density material than the pieces having their wider sides facing radially inward.

6. Apparatus in accordance with claim 5 including an exterior housing enclosing said central body and said fragments.

7. Apparatus in accordance with claim 5 including several circumferential rows of fragments along the length of said munition, the front and rear sides of the row fragments being alternate keystone shaped in the lengthwise direction of said munition also.

8. Apparatus in accordance with claim 6 wherein said housing is thin with respect to said fragments, and wherein said fragments have a high ballistic coefficient.

9. A fragmentation warhead comprising:

(a) a central container or generally cylindrical form for containing a high explosive material;

(b) a plurality of circular rows of ballistic fragments assembled around said central container, at least one of said rows including two types of fragments arranged alternately around the circumference thereof; and (c) a first of said two types being keystone shaped with the wider side thereof facing radially inward, and the second type being of inverted keystone shape relative to said first type, the tapered sides of each said type of fragment being flat and in surface contact with their adjacent fragment in said row, said types of fragments each being formed of appreciably different density materials.

10. Apparatus in accordance with claim 9 including a relatively thin frangible housing enclosing said central container and said fragments, said housing being shaped for forming the outer surface of a missile or the like.

11. Apparatus in accordance with claim 9 wherein said second type fragments are of appreciably higher density material than said first type.

* * * * *